US009463848B2

(12) United States Patent
Merchant et al.

(10) Patent No.: US 9,463,848 B2
(45) Date of Patent: Oct. 11, 2016

(54) SEMI-SUBMERSIBLE INTEGRATED PORT

(71) Applicant: Keppel Offshore & Marine Ltd, Singapore (SG)

(72) Inventors: Aziz Amirali Merchant, Singapore (SG); Hock Choon Edwin Nah, Singapore (SG); Xu Wen Huang, Singapore (SG); Anis Altaf Hussain, Singapore (SG); Ankit Kumar Choudhary, Singapore (SG)

(73) Assignee: Keppel Offshore & Marine Ltd, Singapore (SG)

( * ) Notice: Subject to any disclaimer, the term of this patent is extended or adjusted under 35 U.S.C. 154(b) by 11 days.

(21) Appl. No.: 14/422,666

(22) PCT Filed: Apr. 24, 2013

(86) PCT No.: PCT/SG2013/000165

§ 371 (c)(1),
(2) Date: Feb. 19, 2015

(87) PCT Pub. No.: WO2014/031075

PCT Pub. Date: Feb. 27, 2014

(65) Prior Publication Data

US 2015/0251728 A1 Sep. 10, 2015

(30) Foreign Application Priority Data

Aug. 23, 2012 (SG) ..... PCT/SG2012/000299

(51) Int. Cl.
*B63B 35/50* (2006.01)
*B63B 1/10* (2006.01)
(Continued)

(52) U.S. Cl.
CPC ..... *B63B 1/107* (2013.01); *B63B 21/00* (2013.01); *B63B 29/02* (2013.01); *B63B 35/38* (2013.01);
(Continued)

(58) Field of Classification Search
CPC ..... B63B 1/07; B63B 35/50; B63B 35/4413; B63B 35/38; B63B 35/44; B63B 2035/4473
USPC ..... 114/256, 258, 263, 261
See application file for complete search history.

(56) References Cited

U.S. PATENT DOCUMENTS 4,312,287 A * 1/1982 Kuo ..... B63B 27/02 114/259
6,854,411 B2 2/2005 Ankarsward
(Continued)

FOREIGN PATENT DOCUMENTS

EP 1400442 B1 11/2006
GB 1065216 A 4/1967
(Continued)

OTHER PUBLICATIONS

"Prosafe—Semi Submersible Logistics Hub", www.prosafe.com, 2 Pages.
(Continued)

*Primary Examiner* — Anthony Wiest
(74) *Attorney, Agent, or Firm* — KPPB LLP

(57) ABSTRACT

A semi-submersible platform that is suitable to serve as a logistics hub at a remote offshore location. The semi-submersible platform is configured in a V-shape to reduce motion of the semi-submersible platform caused by rough sea conditions. The semi-submersible platform has a vessel docking area within the platform and a balancing unit to balance the unsymmetrical load of the platform that protects a vessel in the docking area from rough sea conditions.

17 Claims, 6 Drawing Sheets

(51) Int. Cl.

| | |
|---|---|
| ***B63B 35/44*** | (2006.01) |
| ***B63B 21/00*** | (2006.01) |
| ***B63B 29/02*** | (2006.01) |
| ***B63B 35/38*** | (2006.01) |
| ***B63B 39/00*** | (2006.01) |

(52) U.S. Cl.

CPC ..... *B63B 35/44* (2013.01); *B63B 35/4413* (2013.01); *B63B 35/50* (2013.01); *B63B 39/005* (2013.01); *B63B 2035/4473* (2013.01)

(56) References Cited

U.S. PATENT DOCUMENTS

| | | | |
|---|---|---|---|
| 7,086,809 | B2 | 8/2006 | Busso |
| 2002/0090270 | A1 | 7/2002 | Malcolm et al. |
| 2003/0205189 | A1 | 11/2003 | Key et al. |
| 2005/0169714 | A1 | 8/2005 | Merchant et al. |
| 2011/0203507 | A1 | 8/2011 | Ellnor et al. |

FOREIGN PATENT DOCUMENTS

| | | | |
|---|---|---|---|
| GB | 1582468 | A | 1/1981 |
| GB | 2141076 | A | 12/1984 |
| WO | 2012001345 | A1 | 1/2012 |

OTHER PUBLICATIONS

International Preliminary Report on Patentability for International Application No. PCT/SG2013/000165, Report issued Apr. 30, 2014, Mailed Apr. 30, 2014, 16 Pgs.

International Search Report and Written Opinion for International Application No. PCT/SG2013/000165, Search completed Jun. 11, 2013, Mailed Jun. 11, 2013, 10 Pgs.

* cited by examiner

SEMI-SUBMERSIBLE INTEGRATED PORT

CROSS-REFERENCE TO RELATED APPLICATIONS

The current application is a National Stage Application of PCT Application No. PCT/SG2013/000165, entitled "Semi-Submersible Integrated Port," filed Apr. 24, 2013, which claims priority to PCT Application No. PCT/SG2012/000299, entitled "Semi-Submersible Integrated Port," filed Aug. 23, 2012. The disclosures of PCT Application No. PCT/SG2013/000165 and PCT/SG2012/000299 are incorporated herein by reference in their entirety.

FIELD OF THE INVENTION

The present invention relates to a semi-submersible platform suitable to serve as a logistics hub at a remote offshore location. More particularly, this invention relates to a semi-submersible platform configured in a V-shape to reduce the motion of the semi-submersible platform caused by rough sea conditions. Still more particularly, this invention relates to a semi-submersible platform having a vessel docking area within the platform, a balancing unit to balance the unsymmetrical load of the platform and a horizontal brace for absorbing torque forces.

BACKGROUND OF THE INVENTION

Semi-submersible platforms have been widely used in oil and gas exploration/production as these mobile platforms may be moved easily from one site to another. However, as oil and gas explorations and operations move further offshore, various logistical problems arise. Particularly, offshore companies face logistical issues in transporting personnel and supplies to and from platforms located at remote locations or at sites that are located in severe environments. Typically, helicopters are used to transport personnel and supplies when such sites are located less than 150 km from the shore. However, such a transportation method becomes costly, risky and inefficient when the sites are located more than 300 km from the shore. Some typical problems associated with the use of helicopters for transportation to these remote sites include longer flights; the lack of nearby emergency response teams in the event of helicopter/vessel disasters; the lack of in-field servicing/refueling facilities; the lack of in-field storage/warehouse for storing foods and equipment; and the lack of accommodation facilities for personnel.

A solution to the above issues is to have a platform built halfway between the field site and the shore so that helicopters/vessels may be deployed to transport personnel from the shore to the platform, and subsequently to the intended field site. However, this method is still inefficient as the embarkation/disembarkation of personnel and the loading/unloading of materials between a vessel/helicopter and the platform are extremely difficult and dangerous under rough sea conditions. Therefore, under such severe conditions, it is a challenge to ensure that the platform remains stable with minimum motion.

A semi-submersible vessel is described in US Patent Publication No. 2003/0205189 A1 published on 6 Nov. 2003 in the name of Joe Wayne Key et al. This publication discloses a semi-submersible floating production vessel having a ring pontoon with several columns extending upwardly from the pontoon to support a deck on which production modules are positioned. The columns are surrounded with fenders for protecting the columns from impacts with floating bodies. It is an object of this publication to provide a semi-submersible vessel with sufficiently large water plane inertia to ensure adequate stability while minimizing the vessel motion response. It is not an object of this publication to provide a platform that serves as a logistics hub at a remote offshore location. Further, the design does not provide a docking area for ships that protects the ships from rough sea conditions.

A floating marine drilling structure for drilling wells in offshore locations is disclosed in GB Patent No. 1,065,216 published on 12 Apr. 1967 in the name of Laborde et al. This publication discloses a floating structure having a generally V-shaped hull configuration formed by a pair of triangular shaped hull wings. The V-shaped hull structure does not employ cross bracings between the main hull elements as it is disclosed that the hull wing configurations are able to resist the varying stresses acting on the structure. It is also disclosed that the floating structure has a high degree of stability under severe weather conditions as the centre of flotation is substantially coincident with the centre of the structure, where the two substantially triangular wings of the hull meet. The stability of this structure may be increased by increasing the size hull wings. However, as the sizes of the hull wings increase, the hull wings would be subject to higher torque and higher bending forces as the water plane area of the structure increases. In rough sea conditions, such forces could potentially be destructive.

A mooring arrangement for a floating body is disclosed in GB Patent No. 1,582,468 published on 7 Jan. 1981 in the name of Slotnaes. This publication describes a floating harbour installation that is in the shape of a horse shoe, V or U shaped for protecting docked vessels from rough weather. However, the arrangement disclosed in this document may be only be used close to shore or at locations where the base of the arrangement may be securely and fixedly moored to the sea bed.

SUMMARY OF THE INVENTION

The above and other problems are solved and an advance in the art is made by a semi-submersible platform in accordance with the present invention.

A first advantage of a semi-submersible platform in accordance with an embodiment of the present invention is that the platform has a balancing unit formed by one or more upwardly extending columns adjacent to the apex of the V-shaped semi-submersible platform for balancing the unsymmetrical load of the platform at the bow of the platform.

A second advantage of a semi-submersible platform in accordance with an embodiment of the present invention is that the platform has a wide opening at the stern whereby the opening provides access to a docking area within the semi-submersible platform. A vessel is able to berth in this docking area thereby being protected from rough sea conditions.

A third advantage of a semi-submersible platform in accordance with an embodiment of the present invention is that the platform has a horizontal brace that extends between the first pontoon the second pontoon for absorbing torque forces acting on the first and second pontoons. The horizontal brace which is located near the stern of the platform has a rectangular shaped cross-section for improving the stability and handling of the platform.

A fourth advantage of a semi-submersible platform in accordance with an embodiment of the present invention is that the platform is configured to have a V-shape to take the advantage of the directionality of external environments (e.g. strong winds) to reduce the motion of the platform and hence increase the stability of the platform in adverse environmental conditions.

A fifth advantage of a semi-submersible platform in accordance with an embodiment of the present invention is that the platform serves as a logistics hub at a remote offshore location and is equipped with various facilities for offshore exploration and operation, including accommodation facilities, medical facilities, helicopter parking/servicing/refueling facilities, and warehousing facilities.

A sixth advantage of a semi-submersible platform in accordance with an embodiment of the present invention is that the platform has a turret mooring system to allow the platform to adopt the direction of least resistance against the adverse environmental conditions such as strong waves, heavy winds and fast moving currents.

According to an embodiment of the present invention, there is provided a semi-submersible platform having a first end and a second end. The semi-submersible platform comprises a first pontoon on a first side of the semi-submersible platform, and a second pontoon on a second side of the semi-submersible platform. A balancing unit is positioned proximate the first end of the semi-submersible platform and connected to a first end of each of the first and second pontoons forming a V-shaped semi-submersible platform. The balancing unit comprises at least one upwardly extending main column for supporting the load of the V-shaped semi-submersible platform. An opening is defined between the first and second pontoons proximate the second end of the semi-submersible platform to provide a docking area within the semi-submersible platform accessible by a vessel through the opening so that the vessel is protected from rough sea conditions by the semi-submersible platform. A horizontal brace that is positioned proximate the second end of the semi-submersible extends from the first pontoon to the second pontoon. The horizontal brace is for absorbing torque forces acting on the first and second pontoons and for improving the stability and the handling of the semi-submersible platform.

According to an embodiment of the present invention, the semi-submersible comprises a first set of secondary columns extending upwardly from the first pontoon, and a second set of secondary columns extending upwardly from the second pontoon. The first set of secondary columns is aligned substantially parallel and spaced apart from one another. The second set of secondary columns is also aligned substantially parallel and spaced apart from one another.

According to an embodiment of the present invention, the diameter of the main column is larger than the diameter of each secondary column of the first and second sets of secondary columns for balancing the semi-submersible platform. In another embodiment, the main column has an opening extending through the entire length of the main column to allow drilling operations to be performed through the opening.

According to embodiments of the present invention, the balancing unit comprises a set of main columns. In accordance with some of these embodiments, the columns in the set of main columns may be arranged in one of the following configurations: a triangular configuration, a rectangular configuration, or a circular configuration.

According to an embodiment of the present invention, the semi-submersible platform may further comprise a first main deck arranged substantially parallel to and above the first pontoon and connected to the first set of secondary columns. A second main deck arranged substantially parallel to and above the second pontoon and connected to the second set of secondary columns.

According to embodiments of the present invention, the semi-submersible platform further comprises a first extended pontoon extending laterally from a second end of the first pontoon proximate the second end of the semi-submersible platform. A second extended pontoon extending laterally from a second end of the second pontoon proximate the second end of the semi-submersible platform. The first and second extended pontoons are substantially parallel and spaced apart from each other. In accordance with some of these embodiments, the first and second extended pontoons are removable.

According to embodiments of the present invention, the semi-submersible platform further comprises a support pontoon connecting the first and second extended pontoons. In accordance with some of these embodiments, a set of support pontoons connect the first and second extended pontoons.

According to an embodiment of the present invention, the semi-submersible platform further comprises a retractable wall interconnecting columns of the first and second sets of secondary columns and the balancing unit.

According to some embodiments of the present invention, the semi-submersible platform further comprises an extendable deck connecting the first main deck and the second main deck. In accordance with some of these embodiments, the extendable deck is removable.

According to some embodiments of the present invention, the semi-submersible platform further comprises crew quarters on the semi-submersible platform. In some embodiments of the present invention, the semi-submersible platform further comprises a helicopter deck on the semi-submersible platform.

According to some embodiments of the present invention, the semi-submersible platform further comprises a securing mechanism having a first end affixed to the semi-submersible platform and a second end attached to the sides of the vessel that berthed in the docking area.

According to some embodiments of the present invention, the semi-submersible platform further comprises a guiding mechanism for pulling the vessel into the docking area through the opening of the semi-submersible platform. In accordance with some of these embodiments, the guiding mechanism comprises a yoke structure.

According to some embodiments of the present invention, the semi-submersible platform further comprises either an external turret mooring system positioned near the balancing unit or an internal turret mooring system.

BRIEF DESCRIPTION OF THE DRAWINGS

The present invention will now be described, by way of examples only, with reference to the accompanying drawings, in which.

DETAILED DESCRIPTION OF THE INVENTION

Figure 1:
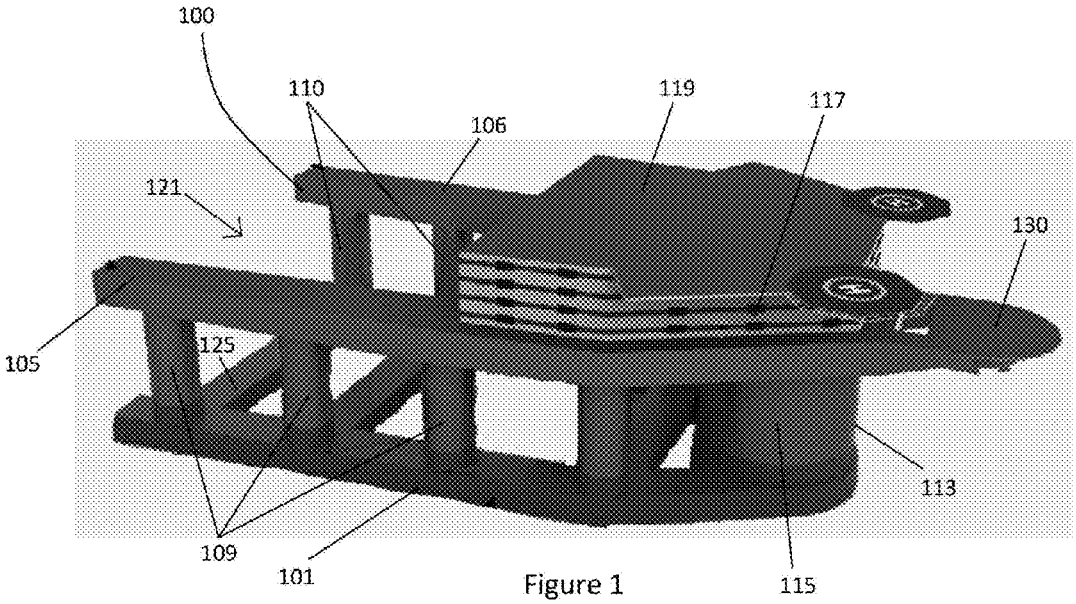
FIG. 1 illustrating a perspective view of a semi-submersible platform in accordance with an embodiment of the present invention.

The present invention relates a semi-submersible platform suitable to serve as a logistics hub at a remote offshore location. More particularly, the present invention relates to a semi-submersible platform configured to have a V-shape to reduce the motion response of the platform during rough sea conditions. Still more particularly, the present invention relates to a semi-submersible platform having a vessel docking area within the platform, a balancing unit to support the unsymmetrical load of the platform and a horizontal brace for absorbing torque forces and for increase the stability/handling of the platform.

Semi-submersible platform 100, shown in FIGS. 1-6, is a semi-submersible integrated port or logistics hub with a docking area in accordance with an embodiment of the present invention. Semi-submersible platform 100 comprises two semi-submersible pontoons 101 and 102 (shown in FIG. 2) that are each preferably in a longitudinally elongated form. In some embodiments, the length of each of the pontoons 101 and 102 is in the range between 50 m and 150 m. First pontoon 101 is on the first side of semi-submersible platform 100 and second pontoon 102 is on the second side of semi-submersible platform 100. Pontoons 101 and 102 are arranged such that they diverge from one another by an angle, θ, of no more than 180°, forming a substantially V-shaped configuration. In operation, pontoons 101 and 102 are submersed underwater and may be raised or submerged further accordingly. One skilled in the art will recognize that the size and shape of pontoons 101 and 102 may be varied without departing from the present invention.

Semi-submersible platform 100 further comprises main decks 105 and 106 that are each preferably in a longitudinally elongated form. First main deck 105 is aligned substantially parallel to and above first pontoon 101. Similarly, second main deck 106 is aligned substantially parallel to and above second pontoon 102. In a preferred embodiment, main decks 105 and 106 are above sea level. However, main decks 105 and 106 may be underwater for other uses. A first set of secondary columns 109 extends upwardly from first pontoon 101 to first main deck 105, and a second set of secondary columns 110 extends upwardly from second pontoon 102 to second main deck 106. Each of secondary columns 109 and 110 is semi-submersible and is preferably cylindrically shaped to support the load of semi-submersible platform 100. In some embodiments, the diameter and height of each of secondary columns 109 and 110 are in the range between 10 m and 20 m and 15 m and 30 m respectively. The columns in each set of secondary columns 109 and 110 are aligned substantially parallel to and spaced apart from one another, as shown in FIG. 1, so as to achieve a stable and even weight distribution of the loads across semi-submersible platform 100. In operation, the lower part of secondary columns 109 and 110 are submersed underwater. One skilled in the art will recognize that the size and shape of main decks 105 and 106 and secondary columns 109 and 110 may be varied without departing from the present invention.

Figure 2:
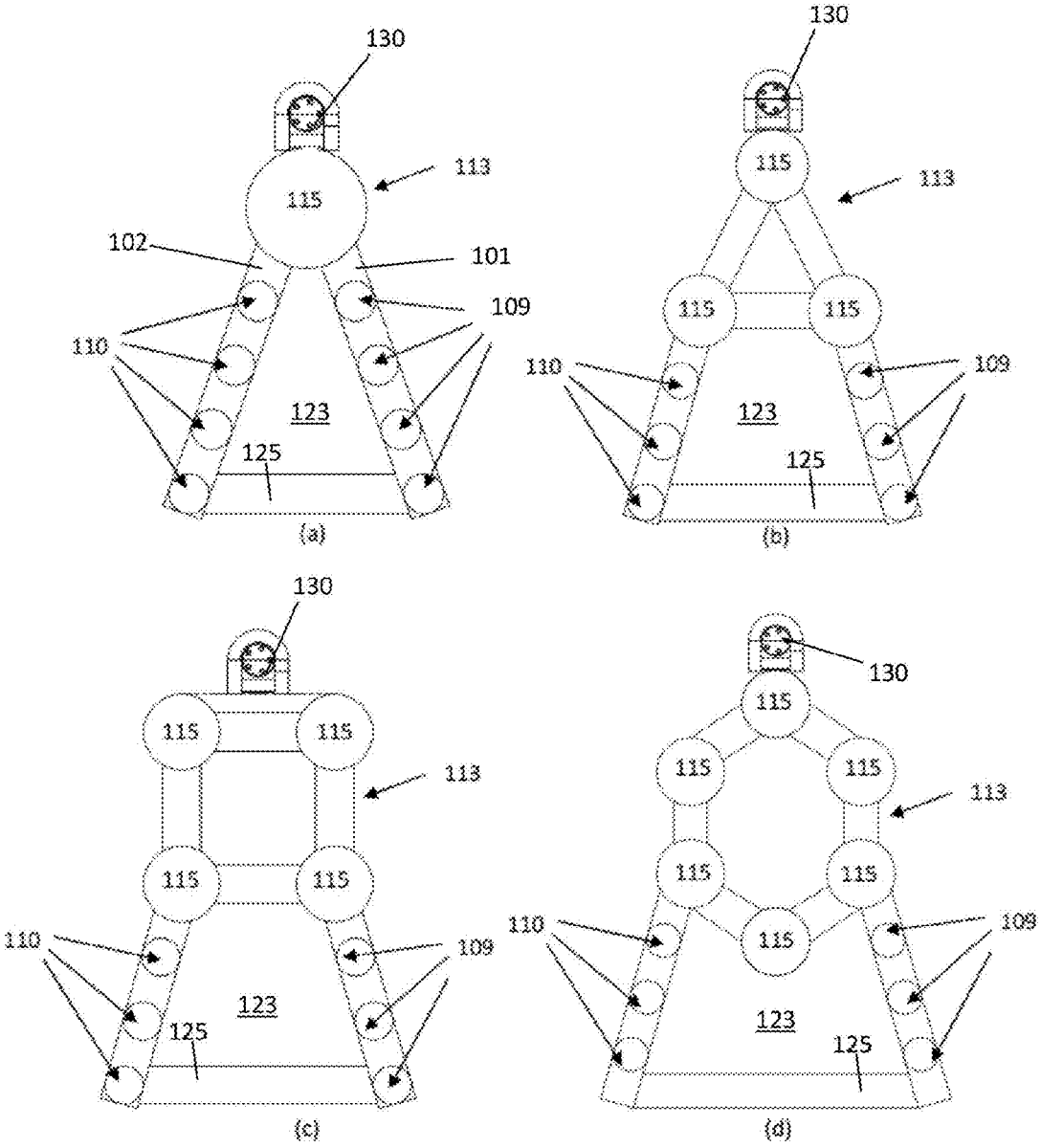
FIG. 2 illustrating a schematic top view of various configurations of a balancing unit in accordance with embodiments of the present invention.

Semi-submersible platform 100 further comprises a semi-submersible balancing unit 113 to support the unsymmetrical load of semi-submersible platform 100. Balancing unit 113 is located proximate the front end of semi-submersible platform 100 and connected (or integrated) to the front end of pontoons 101 and 102 and the associated front end of main decks 105 and 106, forming a V-shaped semi-submersible platform 100. In other words, balancing unit 113 is adjacent to the apex (i.e. front end) of the V-shaped semi-submersible platform 100. Balancing unit 113 is semi-submersible and in operation, the lower part of balancing unit 113 is submersed underwater. Balancing unit 113 comprises at least one upwardly extending main column 115, as shown in FIG. 1 and FIG. 2 (*a*). Main column 115 is preferably cylindrical shape. In some embodiments, balancing unit 113 may comprise a set of main columns 115 arranged in various configurations, such as a triangular configuration (FIG. 2 (*b*)), a rectangular configuration (FIG. 2 (*c*)) and a circular configuration (FIG. 2 (*d*)). In some embodiments, the diameter and height of main column 115 are in the range between 25 m and 50 m and 15 m to 30 m respectively. One skilled in the art will recognise that the size and shape of balancing unit 113 and main column 115 may be varied without departing from the present invention.

Pontoons 101 and 102, first and second sets of secondary columns 109 and 110, and main column 115 of balancing unit 113 may house a ballasting means, e.g. a ballast tank, for facilitating the movement of these parts relative to the sea level. In operation, these ballasting means may be filled or emptied depending on whether platform 100 is to be submerged further or raised further out of the water. Typically, these ballasting means will be gradually filled, with the bigger ballasting means being filled first followed by the smaller ballasting means in order to minimize the yaw and roll of platform 100 as platform 100 is being submerged or raised.

Figure 3:
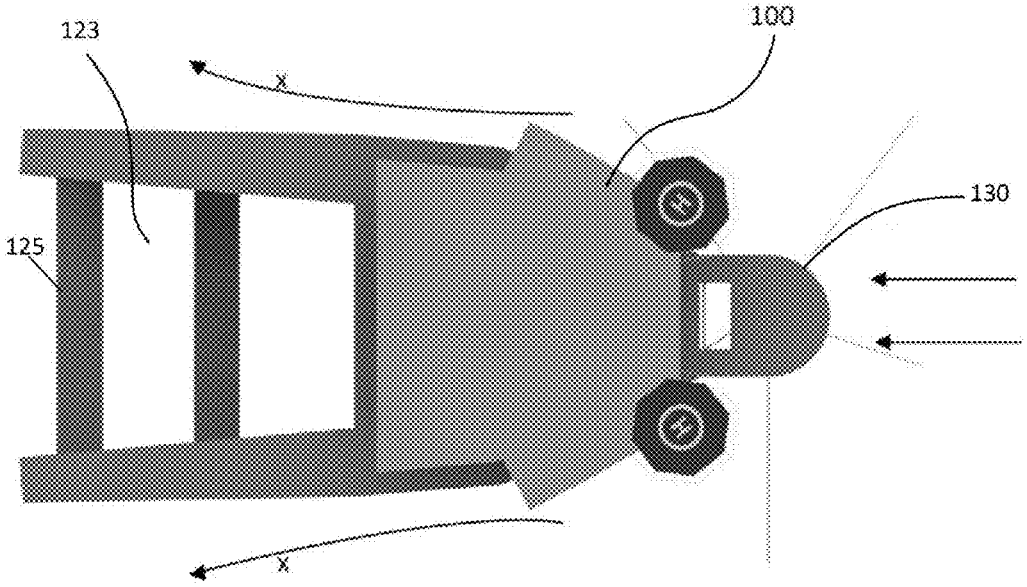
FIG. 3 illustrating a top view of a semi-submersible platform in accordance with an embodiment of the present invention.

Semi-submersible platform 100 also comprises horizontal brace 125. Horizontal brace 125 extends from first pontoon 101 to second pontoon 102. In an embodiment of the invention, horizontal brace 125 is positioned near the stern of platform 100. In harsh environmental conditions, strong torque forces and strong bending forces act against pontoons 101 and 102, causing these pontoons to twist and turn, straining the connection between the pontoons and balancing unit. Horizontal brace 125 is able to absorb the torque and bending forces acting on pontoons 101 and 102 thereby allowing platform 100 to continue operating even under the harshest weather conditions. In other embodiments of the invention, platform 100 may have more than one horizontal brace extending between pontoons 101 and 102. In FIGS. 1 and 3, two horizontal braces are shown. However, one skilled in the art will recognize that any number of horizontal braces may be implemented on platform 100 without departing from this invention. Unlike conventional floating harbours, the ballasting means on platform 100 may be ballasted and de-ballasted as required in accordance with the height of the docking vessel. By doing so, the operators of platform 100 are able to ensure that the keel of a docking vessel does not come into contact with horizontal brace 125 of platform 100. In accordance with further embodiments of the invention, the stability and handling of platform 100 may be improved by selecting horizontal braces with rectangular cross-sections. By selecting rectangular shaped braces, this effectively provides platform 100 with a more stable base to withstand wave motions even in rough weather conditions as such a shape would encourage the entirety of platform 100 to move as a single unit against or with the motion of the waves. This unified movement of platform 100 greatly reduces the bending and torque forces acting on pontoons 101 and 102 allowing platform 100 to withstand the harshest elements.

As the load nearer the apex of the V-shaped semi-submersible platform 100 is generally heavier than other parts of platform 100, this creates an uneven weight distribution that needs to be counter-balanced. For example, main machineries, crew quarters 117 and helicopter deck 119 may be located near the apex of the V-shaped semi-submersible platform 100. Therefore, the diameter and size of main column 115 proximate the apex region of platform 100 should be larger than the diameter and size of secondary columns 109 and 110 in order to support the unsymmetrical load of platform 100 and in order for semi-submersible 100 to be properly balanced. In some embodiments, main column 115 has an opening (not shown) extending through the entire length of main column 115 to allow drilling operations (or other suitable offshore operations) to be performed through the opening and to allow connection to the sea bed through the bottom opening of main column 115 that is submersed underwater.

An opening 121 is defined between pontoons 101 and 102 and the associated main decks 105 and 106. Opening 121 is located proximate the rear end (opposite the apex) of the V-shaped semi-submersible platform 100. A docking area 123 is provided within semi-submersible platform 100 between pontoons 101 and 102 and the associated main decks 105 and 106. Docking area 123 is accessible by a vessel through opening 121 so that a vessel berthed in docking area 123 is protected from rough sea conditions, e.g. strong winds and/or waves. The size of docking area 123 is determined by opening 121 which in turn is determined by angle θ between pontoons 101 and 102. A larger angle θ has a larger opening 121 which then provides a larger docking area 123 for receiving a larger vessel. In some embodiments, docking area 123 provides a berth for a vessel approximately 150 m in length and 50 m in width.

The V-shaped semi-submersible platform 100 takes advantage of the directionality of external environments (e.g. swell and current direction) by deflecting the environmental loads away from platform 100. For example, when strong winds approach the apex of the V-shaped semi-submersible platform 100, the winds split and pass along both sides of semi-submersible platform 100 towards the rear end, as shown by arrows X in FIG. 3. This results in a reduction of the motion of the semi-submersible platform 100 in response to rough sea conditions and protects a vessel berthed in docking area 123 from the rough sea conditions.

In accordance with other embodiments of the invention, platform 100 further comprises external turret mooring system 130. In this embodiment, external turret mooring system 130 is provided proximate balancing unit 113. External turret mooring system 130 comprises a number of anchor lines, a turret column, and a bearing arrangement. External turret mooring system 130 (which is fixed via a number or anchor lines to the seabed) allows platform 100 to freely weather vane around, adopting the direction of the least resistance against waves, wind and currents. For docking operations, this is advantageous as platform 100 is able to automatically adopt a heading that provides the least resistance against the raging elements. Without external turret mooring system 130, the operator of platform 100 would have to rely on other instruments to determine the most suitable heading for docking operations. By utilizing the V-shaped feature of platform 100 and external turret mooring system 130, platform 100 would automatically weather vane into a position that would be optimum for docking operations to take place through opening 121. In this position, the apex of the V-shaped platform would be presented towards the raging winds and waves, and these winds and waves would split and pass along both sides of semi-submersible platform 100 towards the rear end as illustrated in FIG. 3. As the impact of the elements is greatly reduced, this in turn simplifies the docking procedure for incoming vessels, making the whole docking process safer. In other embodiments of the invention, external turret mooring system 130 may be replaced by an internal turret mooring system (not shown). The workings of an internal turret mooring system are not disclosed for brevity as such systems are known to one skilled in the art.

Figure 4:
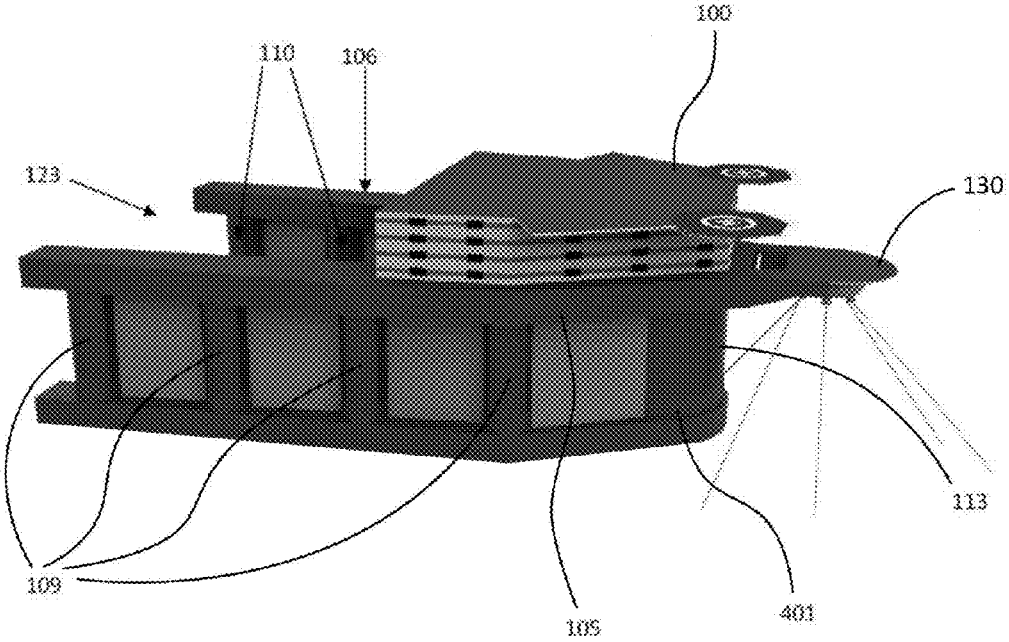
FIG. 4 illustrating a perspective view of a semi-submersible platform with a retractable wall in accordance with an embodiment of the present invention.

Furthermore, in some embodiments, semi-submersible platform 100 may include a retractable wall 401 that interconnects secondary columns (109 and 110) and balancing unit 113, as shown in FIG. 4. Therefore, retractable wall 401 effectively acts as an additional protective barrier for the vessel berthed in docking area 123. This allows a vessel to dock safely even during rough sea conditions. Once the vessel is berthed in docking area 123, embarkation/disembarkation of passengers and loading/unloading of materials may safely take place on main decks 105 and 106.

Figure 5:
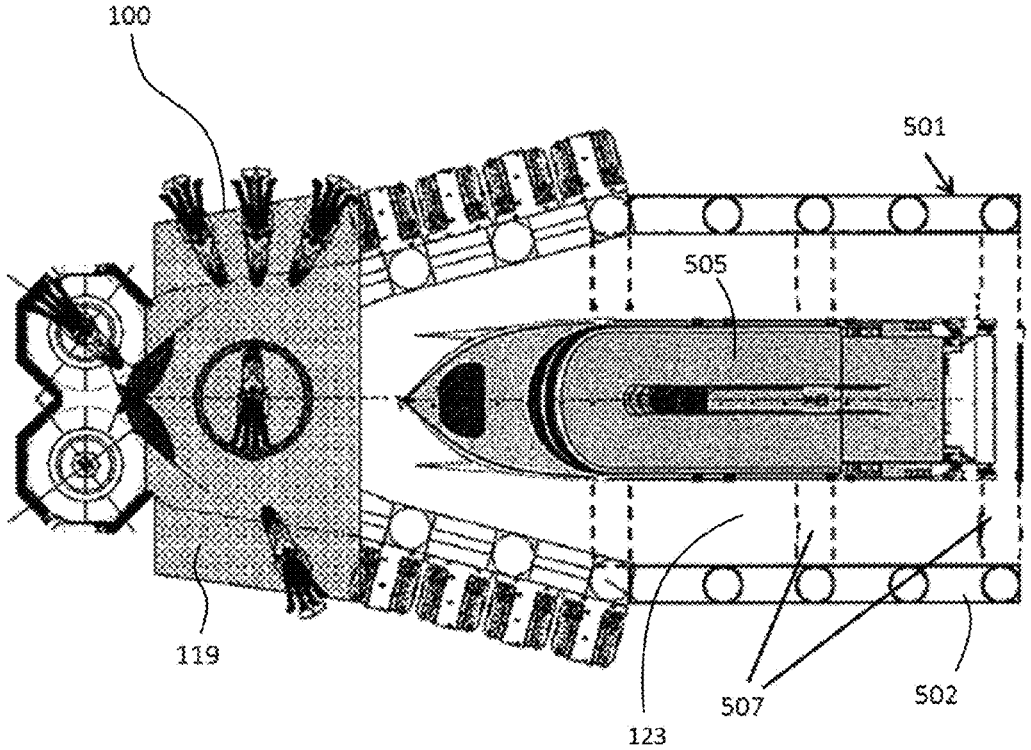
FIG. 5 illustrating a top view of a semi-submersible platform with extended portions in accordance with an embodiment of the present invention.

FIG. 5 shows that semi-submersible platform 100 may include two extended portions 501 and 502 proximate the rear end of semi-submersible platform 100 to create a longer docking area 123 for receiving a longer vessel 505. Each of extended portions 501 and 502 is preferably in a longitudinally elongated form. In some embodiments, the length of each of the extended portions 501 and 502 is in the range between 50 m and 100 m. First extended portion 501 is on the first side of semi-submersible platform 100, and second extended portion 502 is on the second side of semi-submersible platform 100. First extended portion 501 comprises a first extended pontoon and the associated first extended main deck connected by a first set of upwardly extending columns. Second extended portion 502 comprises a second extended pontoon and the associated second extended main deck connected by a second set of upwardly extending columns. The first extended pontoon extends laterally from the rear end of first pontoon 101, and the second extended pontoon extends laterally from the rear end of second pontoon 102. The first and second extended pontoons are substantially parallel and sufficiently spaced apart from each other to receive vessel 505. The extended portions 501 and 502, and hence the first and second extended pontoons, are removable from semi-submersible platform 100. In some embodiments, there is a support pontoon 507 connects the first and second extended pontoons to strengthen the structure of extended portions 501 and 502. More than one support pontoon 507 may be used without departing from this embodiment of this invention.

Figure 6:
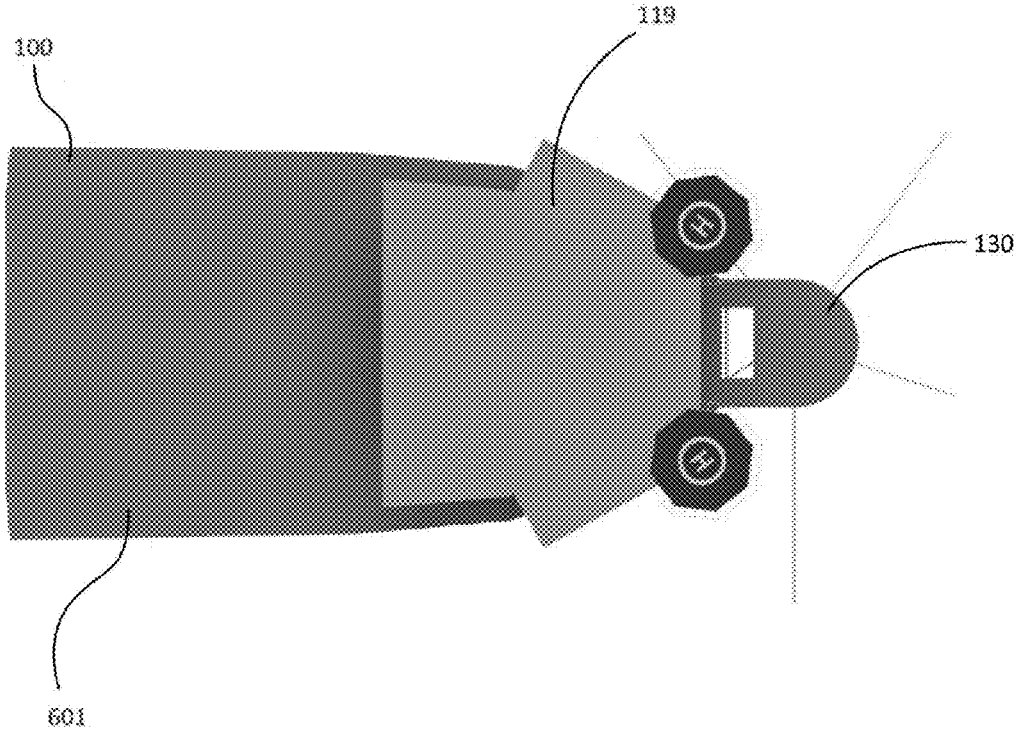
FIG. 6 illustrating a top view of a semi-submersible platform with an extendable deck in accordance with an embodiment of the present invention.

Semi-submersible platform 100 may include crew quarters 117 for personnel and parking area 119 for helicopters. Typically, crew quarters 117 is disposed above main decks 105 and 106 proximate the apex of semi-submersible platform 100, and parking area 119 for helicopters is disposed above crew quarters 117. In some embodiments, as shown in FIG. 6, semi-submersible platform 100 may include an extendable deck 601 that connects first main deck 105 and second main deck 106. Extendable deck 601 is useful if additional space is required, such as for additional crew quarters, production facilities, and warehouses for foods and/or equipment. This allows a large number of personnel to remain on semi-submersible 100 for extended periods of time and/or allows more production activities to be performed on semi-submersible platform 100. Extendable deck 601 is extendable to cover the entire area (or any desired area size) between main decks 105 and 106. Extendable deck 601 is also retractable and removable so as to create a space for docking a vessel.

In some embodiments, in order to stabilize a vessel in docking area 123 and to prevent the vessel from bumping into sides of docking area 123, a securing mechanism (not shown) may be employed to hold a vessel steady as the vessel is berthed in docking area 123. The securing mechanism includes a first end affixed to semi-submersible platform 100 and a second end attached to the both sides of the vessel. In some other embodiments, semi-submersible platform 100 may include a guiding mechanism (not shown) for pulling the vessel into docking area 123. The guiding mechanism may comprise a yoke structure (not shown) which has a general V-shape or U-shape with two arms extending towards the vessel and the end of the arms are securely fastened to both sides of the vessel. Therefore, when the yoke structure moves towards the apex of semi-submersible platform 100, the vessel will be pulled into docking area 123.

The above embodiments provide a description of features and advantages of a V-shaped semi-submersible platform with a docking area that reduces motion of the platform under rough sea conditions in accordance with the present invention. It is envisioned that those skilled in the art can and will design alternative embodiments that infringe on the present invention as set forth in the following claims.

What is claimed is:

1. A semi-submersible platform having a first end and a second end, the semi-submersible platform comprising:

a first pontoon on a first side of the semi-submersible platform;

a second pontoon on a second side of the semi-submersible platform;

a balancing unit proximate the first end of the semi-submersible platform and connected to first ends of each of the first and second pontoons to define an opening between the first and second pontoons proximate the second end of the semi-submersible platform to provide access to a berthing area for a vessel within the semi-submersible platform wherein the balancing unit comprises at least one upwardly extending main column for supporting a load on a top surface of the balancing unit;

a horizontal brace extending between the first pontoon and the second pontoon, positioned proximate the second end of the semi-submersible platform for absorbing torque forces acting on the first and second pontoons, wherein the horizontal brace has a rectangular cross-section for improving stability and handling of the semi-submersible platform;

a turret mooring system;

a yoke structure for guiding the vessel into the berthing area through the opening;

a first set of secondary columns extending upwardly from the first pontoon;

a second set of secondary columns extending upwardly from the second pontoon; and a retractable wall interconnecting columns of the first and second sets of secondary columns and the balancing unit.

2. The semi-submersible platform of claim 1, the diameter of at least one main column is larger than the diameter of each secondary column of the first and second sets of secondary columns for improving buoyancy of the semi-submersible proximate the first end of the semi-submersible platform.

3. The semi-submersible platform of claim 1 wherein at least one main column has an opening extending through the entire length of the main column to allow drilling operations to be performed through the opening.

4. The semi-submersible platform of claim 1 wherein the balancing unit comprises a set of main columns arranged in a substantially triangular configuration.

5. The semi-submersible platform of claim 1 wherein the balancing unit comprises a set of main columns arranged in a substantially rectangular configuration.

6. The semi-submersible platform of claim 1 wherein the balancing unit comprises a set of main columns arranged in a substantially circular configuration.

7. The semi-submersible platform of claim 1 further comprising:

a first main deck supported by the first set of secondary columns; and a second main deck supported by the second set of secondary columns.

8. The semi-submersible platform of claim 7 further comprising:

an extendable deck connecting the first main deck and the second main deck.

9. The semi-submersible platform of claim 8 wherein the extendable deck is removable.

10. The semi-submersible platform of claim 1 further comprising:

a first extended pontoon extending laterally from a second end of the first pontoon proximate the second end of the semi-submersible platform; and a second extended pontoon extending laterally from a second end of the second pontoon proximate the second end of the semi-submersible platform, wherein the first and second extended pontoons are substantially parallel and spaced apart from each other.

11. The semi-submersible platform of claim 10 wherein the first and second extended pontoons are removable.

12. The semi-submersible platform of claim 10 further comprising:

a support pontoon connecting the first and second extended pontoons.

13. The semi-submersible platform of claim 1 wherein the load comprises:

crew quarters.

14. The semi-submersible platform of claim 1 wherein the load comprises:

a helicopter deck.

15. The semi-submersible platform of claim 1 further comprising:

a securing mechanism having a first end affixed to the semi-submersible platform and a second end for attaching to the sides of the vessel that berthed in the berthing area.

16. The semi-submersible platform of claim 1 wherein the turret mooring system is positioned proximate the balancing unit.

17. The semi-submersible platform of claim 1 wherein the turret mooring system is positioned within the semi-submersible platform structure.

* * * * *